US007252195B2

(12) United States Patent
Mandle et al.

(10) Patent No.: US 7,252,195 B2
(45) Date of Patent: Aug. 7, 2007

(54) CONTAINER WITH LID ADAPTED TO SUPPORT A CLEANING PAD AND PACKAGING CONTAINING THE SAME

(75) Inventors: James S. Mandle, Woodcliff Lake, NJ (US); Charles F. Flynn, IV, Oak Ridge, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 10/228,714

(22) Filed: Aug. 27, 2002

(65) Prior Publication Data

US 2004/0040878 A1 Mar. 4, 2004

(51) Int. Cl.
*B65D 85/16* (2006.01)

(52) U.S. Cl. ..... 206/494; 206/812; 220/521

(58) Field of Classification Search ..... 206/233, 206/449, 476, 482, 494, 812, 425, 77.1; 220/521; 221/34, 45, 63; 229/103.2, 87.01
See application file for complete search history.

(56) References Cited

U.S. PATENT DOCUMENTS 2,401,127 A 5/1946 Younghusband
3,179,275 A 4/1965 Roskam
3,688,895 A * 9/1972 Wilson ..... 206/77.1
3,726,395 A * 4/1973 Duhy ..... 206/449
4,214,661 A * 7/1980 Turetsky et al. ..... 206/466
4,314,897 A 2/1982 Monte et al.
4,361,231 A 11/1982 Patience
4,593,816 A * 6/1986 Langenbeck ..... 206/425
4,671,453 A * 6/1987 Cassidy ..... 229/102
4,778,048 A 10/1988 Kaspar et al.
4,836,368 A 6/1989 Cotton
5,429,265 A * 7/1995 Maire et al. ..... 220/522
5,507,385 A * 4/1996 Koloski et al. ..... 206/372
5,540,381 A * 7/1996 Davis ..... 229/103.2
5,542,567 A * 8/1996 Julius ..... 221/63
5,964,372 A * 10/1999 Dubois et al. ..... 220/642
6,779,681 B2 * 8/2004 Doerfler et al. ..... 220/835

* cited by examiner

*Primary Examiner*—Mickey Yu
*Assistant Examiner*—J. Gregory Pickett
(74) *Attorney, Agent, or Firm*—Allen R. Kipnes

(57) ABSTRACT

A container for storing cleaning pads which includes as part of the lid, a used cleaning pad storage area in which a used cleaning pad may be stored between uses. A packaging system for the container having an anti-tampering feature is also provided.

18 Claims, 5 Drawing Sheets

CONTAINER WITH LID ADAPTED TO SUPPORT A CLEANING PAD AND PACKAGING CONTAINING THE SAME

FIELD OF THE INVENTION

The present invention is directed to a container storing flat cleaning articles in the form of a sheet-like pad while providing a place for a used cleaning pad to be placed outside of the storage compartment without contacting unused cleaning pads. There is also provided a package for housing the container which provides an anti-tampering feature so that it can be immediately known if the contents of the container have been tampered with when the container is on display in a retail establishment.

BACKGROUND OF THE INVENTION

Containers for storing essentially flat cleaning pads, applicators and the like are known in the art such as disclosed in Younghusband (U.S. Pat. No. 2,401,127); Roskam (U.S. Pat. No. 3,179,275); Monte et al. (U.S. Pat. No. 4,314,897); Patience (U.S. Pat. No. 4,361,231); Kaspar (U.S. Pat. No. 4,778,048); and Cotton (U.S. Pat. No. 4,836,368). None of these devices, however, address a long standing problem in using containers that store cleaning pads, particularly those that are capable of absorbing liquids.

In particular, typically flat sheet-like, cleaning pads have a wide range of commercial and household uses. Such pads may be used to clean utensils, dinnerware, counter tops, machinery, windows and the like. Such pads may be absorbent in that they are capable of absorbing liquid (e.g cleaning solution, water and the like) while used to clean various surfaces. When the consumer is finished with a cleaning pad, there is typically no place associated with the container to place the used pad until it may be used again. The consumer must therefore find another place to place the used pad or to discard the same which may be premature in that the pad may be used several times before it is necessarily discarded.

In addition, containers for housing cleaning pads are often sold in packages having advertising copy and information about the product printed thereon. One form of packaging is a sleeve which fits over the container and may be easily removed from the container so that the consumer may gain access to the container and the cleaning pads contained therein. There is a problem associated with such packaging systems in that the package may be removed by an unscrupulous person to expose the container and to remove the contents of the container (i.e. the cleaning pads) and then the packaging placed about the empty container without detection.

It would therefore be a significant advance in the art of containers for packaging cleaning pads to provide an area associated with the container for placing a used cleaning pad, especially in a position so that it may readily dry before being used again. It would be a further advance in the art of such containers to provide protection against removal of the packaging from the container by an unscrupulous person to gain access to the cleaning pads contained within the container.

SUMMARY OF THE INVENTION

The present invention is generally directed to a container for storing cleaning pads in which the lid of the container is provided with a used cleaning pad storage area that provides a readily accessible and effective means of storing a used cleaning pad until further use and preferably provides the used cleaning pad with the opportunity to free itself of excess liquid so that it may be used again more quickly than merely placing a used cleaning pad on a flat surface such as a counter top.

The present invention is also directed to a packaged container for storing cleaning pads in which there is an operative connection between the container and the packaging such that once the packaging is removed from the container it may not be placed back over the container without detection. Thus, the consumer can readily determine if a packaged container has been tampered with prior to purchase.

In one particular aspect of the present invention, there is provided a container for storing cleaning pads comprising a housing containing a storage compartment for storing said cleaning pads and a lid operatively connected to the housing for reversibly covering the storage compartment, said lid comprising a used cleaning pad storage area on an upper surface thereof in which a used cleaning pad may be stored between uses.

In a further aspect of the present invention, there is provided a packaged container for storing cleaning pads and a packaging for said container in which there is provided a tamper indicating assembly to prevent or deter tampering. In one embodiment, the container contains a packaging engaging attachment device and the package contains a container engaging attachment device in which the two attachment devices are operatively connected to each other when the packaged container is on display. When the package is removed from the container and thus no longer covers the container, the respective attachment devices are irrevocably disengaged from each other and the package is altered so that it can not effectively be replaced over the container.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed to a container for storing cleaning pads in which the cleaning pads after use may be placed on top of the lid and placed thereon in a manner which facilitates removal of excess liquid and rapid drying so that the cleaning pad may be reused when desired by the consumer. In a further aspect of the present invention, there is provided a packaged container in which the package and container are operatively connected so as to provide an anti-tampering benefit.

Figure 1:
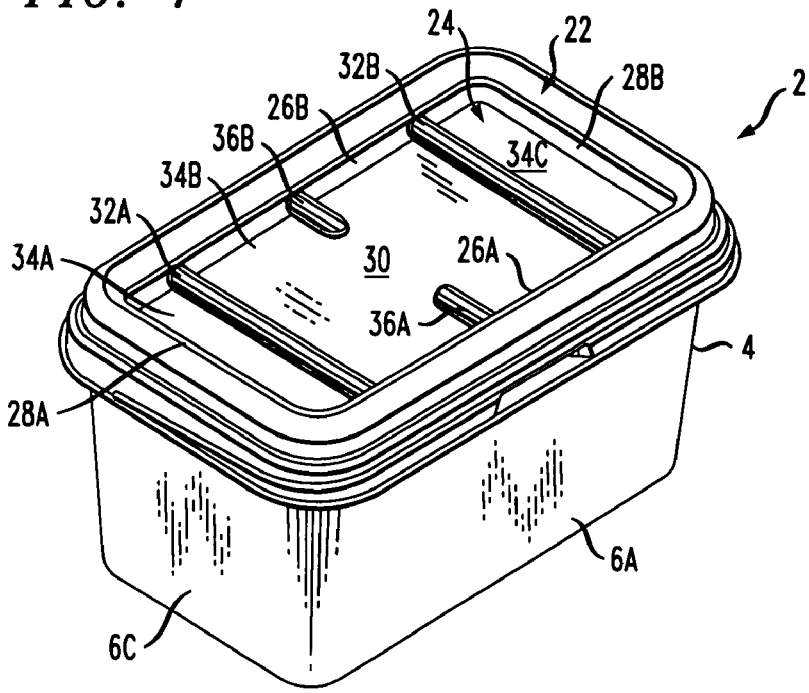
FIG. 1 is a perspective view of an embodiment of a container for cleaning pads in accordance with the present invention.
Figure 2:
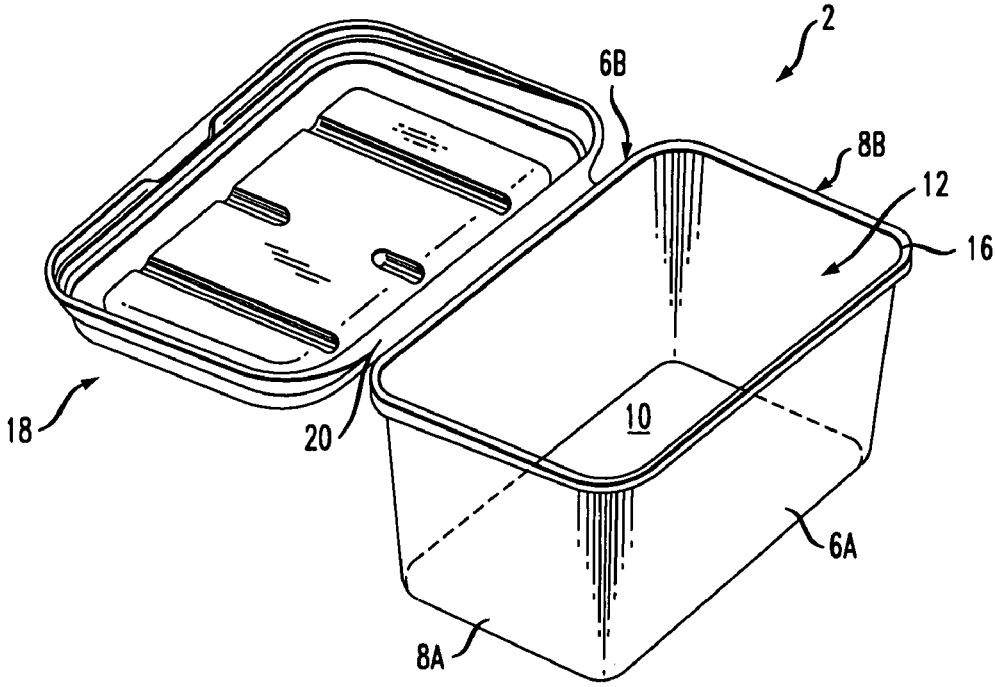
FIG. 2 is a perspective view of the embodiment of the container shown in FIG. 1 with the lid in the open position exposing the storage compartment.
Figure 3:
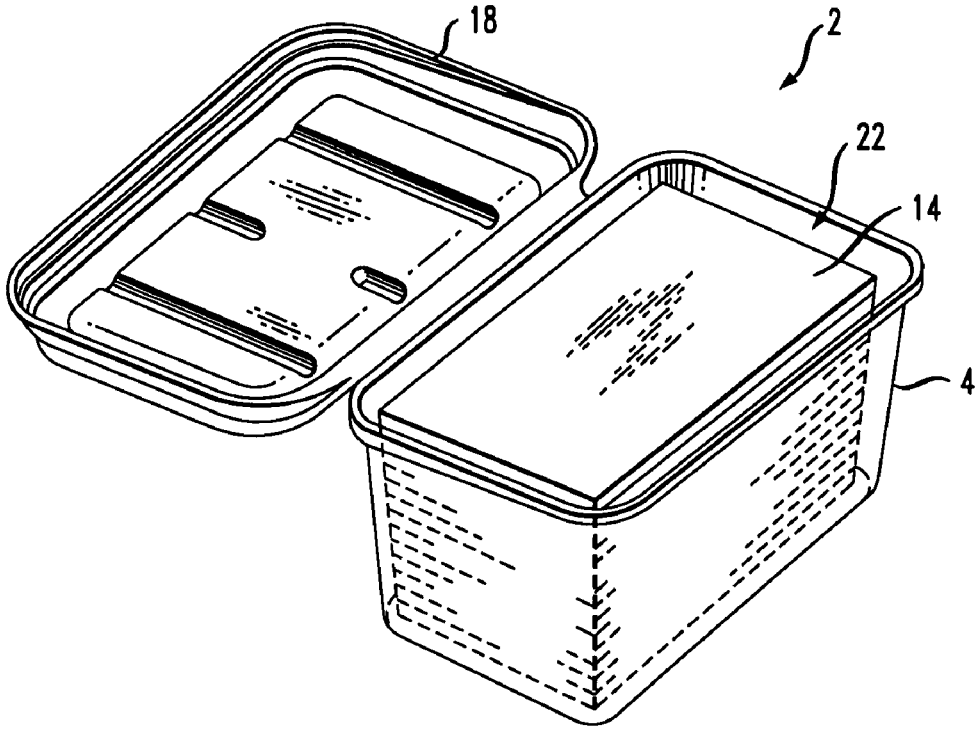
FIG. 3 is a perspective view of the embodiment of FIG. 2 showing the storage compartment filled with cleaning pads.
Figure 4:
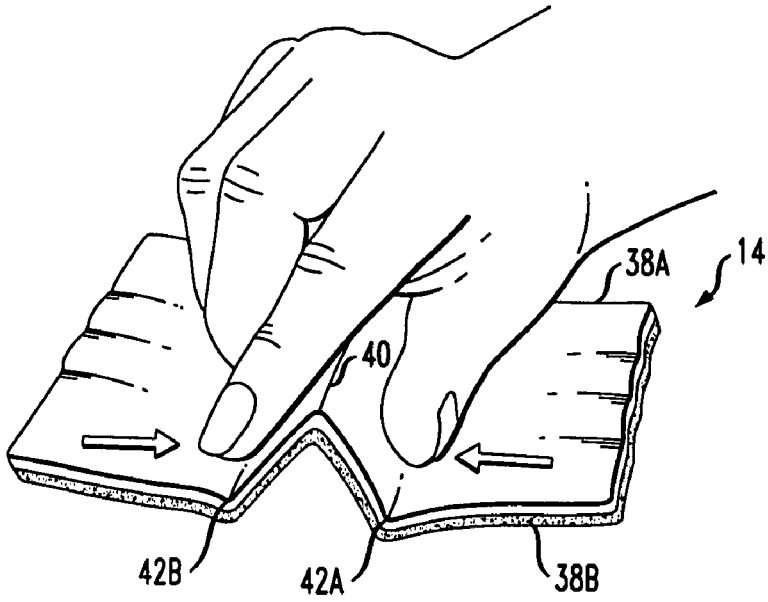
FIG. 4 is a perspective view of a cleaning pad that may be stored in the container of the present invention.

Referring to the drawings and first to FIGS. 1-3 there is shown a container 2 suitable for storing cleaning pads which generally will have the shape of the container (e.g. rectangular). It will be understood that the shape of the container can vary including any polygonal shape as well as a circle, with the shape of the container being chosen to effectively accommodate the cleaning pads.

The container 2 is comprised of a housing 4 having opposed pair of sides 6A, 6B and 8A, 8B as well as a base 10 thereby defining a storage compartment 12 having an open end 16. The shape of the storage compartment is therefore defined by the respective opposed pair of sides to effectively store in an economical and efficient fashion cleaning pads 14 as shown in FIG. 3. The cleaning pads 14 may be removed from the storage compartment 12 by inserting one's hand into the open end 16 of the housing 4.

The storage compartment is reversibly covered by a lid 18, preferably hingedly connected through a hinge 20. It will be understood that the lid need not be connected at all times to the container such as by the hinge 20. Instead, the lid 18 may be completely removable from the container 2. The lid 18 is therefore movable from a closed position shown in FIG. 1 to an open position as shown in FIG. 2 allowing access to the cleaning pads 14 through the open end 16 stored within the storage compartment 12. The manner in which the lid is reversibly connected to the housing 4 to thereby cover the storage compartment is routine and can be accomplished by interlocking detents, pressure fitting, clips and the like. The manner in which the lid 18 interacts with the housing 4 does not form a material feature of the present invention.

Referring again to FIG. 1, the top of the lid 18 is provided with a used cleaning pad storage area 22 which is comprised of a recess 24 defined by opposed pair of sides 26A, 26B and 28A, 28B and a base 30. Attached to the base 30 and extending between opposed sides 26A and 26B are a pair of spaced apart rails 32A and 32B which serve as a resting place for the respective ends of the cleaning pads 14 as described hereinafter.

The spaced apart rails 32A and 32B in conjunction with the sides 26A, 26B and 28A, 28B as well as the base 30 form liquid collection areas 34A, 34B and 34C in which excess liquid from a used cleaning pad can collect while the cleaning pad 14 is resting within the used cleaning pad storage area 22.

As shown in FIG. 1, the number of rails 32A and 32B may be increased to include one or more additional rails or partial rails as shown in FIG. 1. In particular, FIG. 1 shows the addition of opposed partial rails 36A and 36B which can provide additional support for the used cleaning pad 14 as it rests in the used cleaning pad storage area 22.

Figure 5:
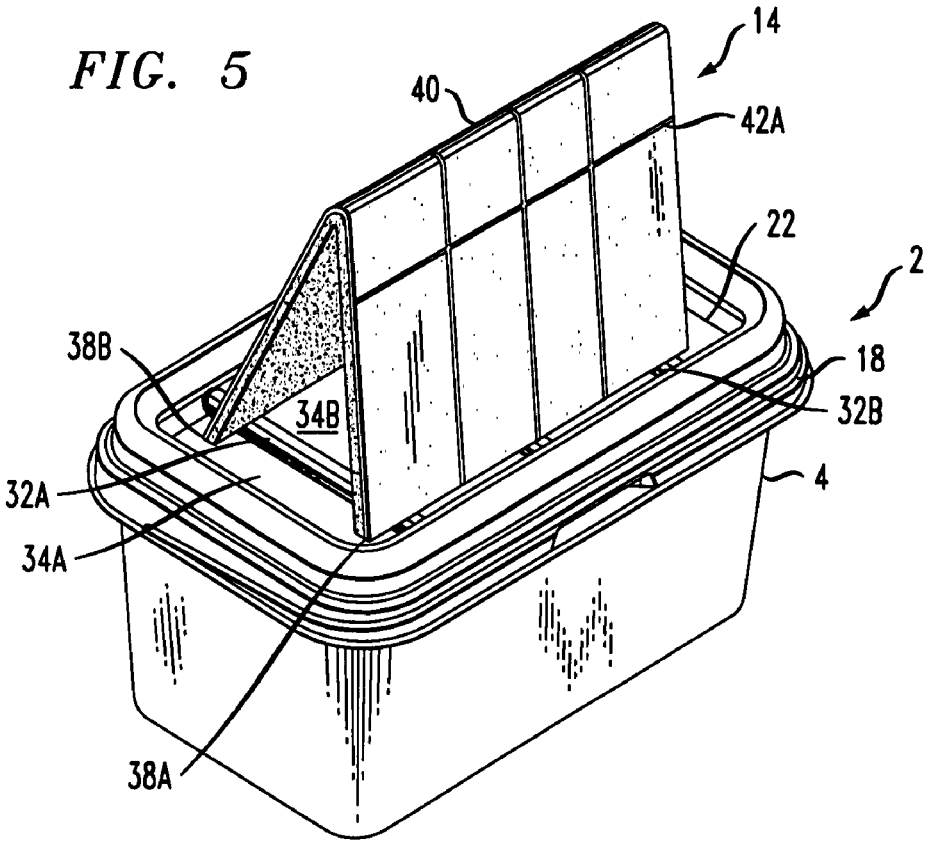
FIG. 5 is a perspective view of the container showing a used cleaning pad being stored in the used cleaning pad storage area appearing on the lid of the container.
Figure 6:
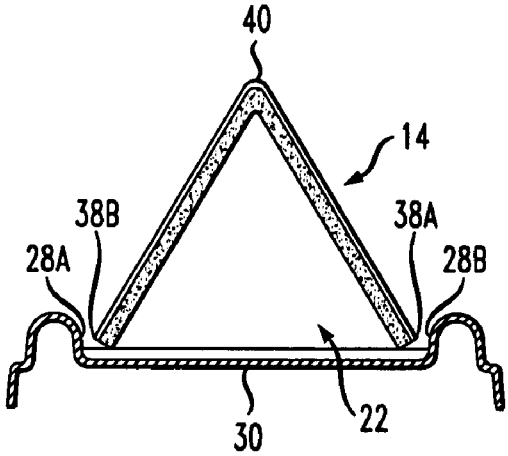
FIG. 6 is a side view of the used cleaning pad in the storage area as shown in FIG. 5.
Figure 7:
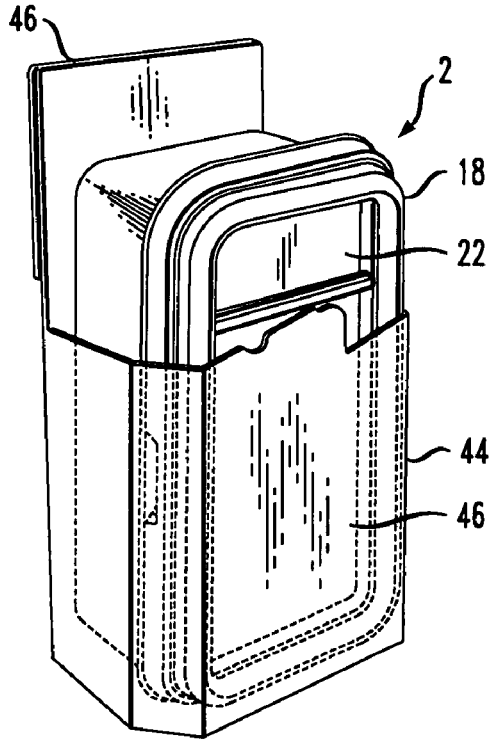
FIG. 7 is a perspective view of a package container in accordance with the present invention in which the package is in the form of a sleeve circumscribing a portion of the container.

Referring to FIGS. 5 and 6, the used cleaning pad 14 is placed upright in a folded over condition so that the respective ends 38A and 38B rest upon the rails 32A and 32B and optionally the additional rails 36A and 36B. In addition, the opposed sides 26A and 26B of the used cleaning pad storage area 22 provide additional support for the cleaning pad 14 to maintain the same in the upright position when it is stored for drying and reuse.

It will be noted that the position of the used cleaning pad 14 on the rails 32A and 32B insures the ends 38A and 38B are above the base 30 of the used cleaning pad storage area 22. This enables excess liquid contained within the used cleaning pad 14 to drip out of the cleaning pad and into the respective liquid collection areas 34A-34C. This facilitates drying of the used cleaning pad making it more suitable for reuse in a relatively short period of time.

The cleaning pads 14 which may be stored in the container 2 can be any shape but preferably are relatively thin sheet-like cleaning pads, typically up to about one-half inch more typically from about one-eighth to one-quarter inch thick and in the embodiments shown in FIGS. 1-3 would have a generally rectangular shape. However, as previously indicated, the shape of the cleaning pad 14 can be any shape corresponding to the shape of the container and can include any polygonal shape as well as a circular shape. Furthermore, the materials used to construct the cleaning pads can be any material suitable for cleaning substrates in household or commercial settings.

In a preferred form of the invention, the cleaning pad will be made of a material which can absorb liquid and therefore can be made of such materials as non-woven materials, liquid absorbing synthetics such as, but not limited to, rayon, cotton and polypropylene. In a further preferred form of the cleaning pad, there is provided a central score line 40 which enables the user to facilitate placing the used cleaning pad in the position shown in FIG. 5 so that it effectively rests within the used cleaning pad storage area 22. Other score lines may be provided to facilitate the user gripping the cleaning pad 14 when in use.

The container 2 of the present invention may be packaged in a point of sale display system that provides an anti-tampering feature. Referring to FIGS. 7-10 and first to FIG. 7, there is shown the container 2 with the lid 18 in the closed position and the upper portion of the used cleaning pad storage area 22 exposed within a sleeve type package 44 which circumscribes the container 2. The package 44 includes a front panel 46 on which may be printed point of sale display information and advertisements. There is also provided a rear panel 48 which, as described below, cooperates with the container to provide an anti-tampering feature.

Figure 8:
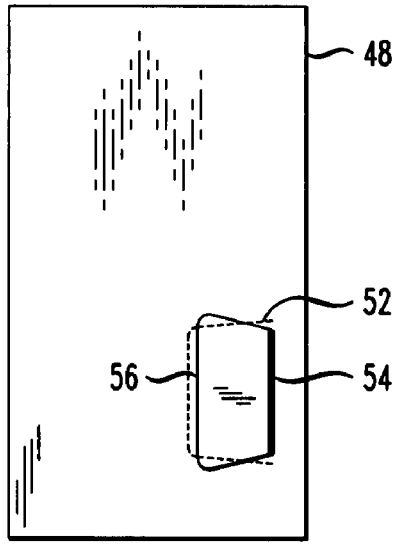
FIG. 8 is a rear view of the rear panel of the packaging showing a container attachment device for engaging the container when the package is in operative contact with the container.
Figure 9:
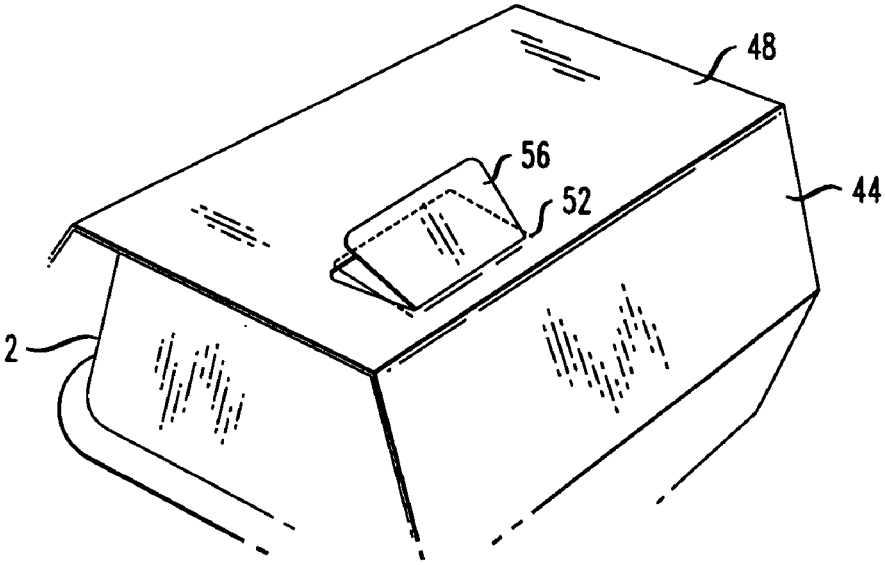
FIG. 9 is a rear view of the package in operative contact with the container showing the package engaging device operatively connected to the container engaging device.
Figure 10:
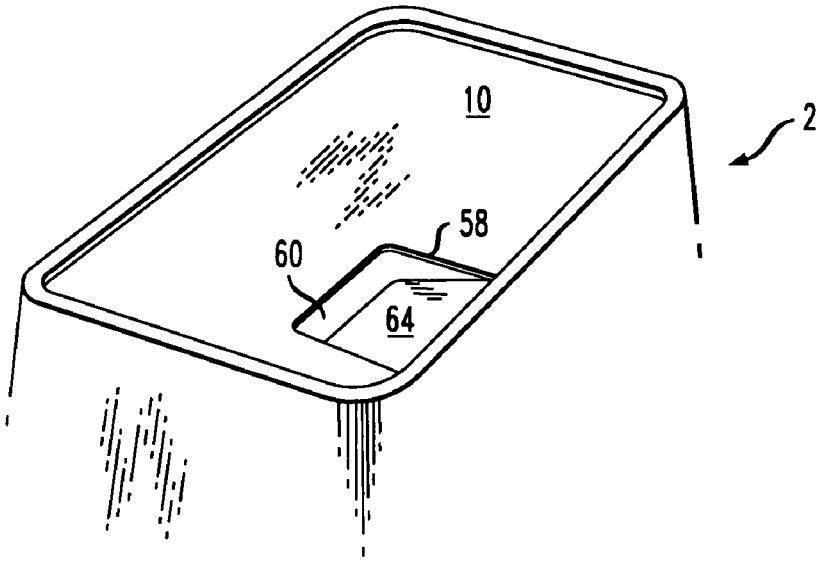
FIG. 10 is a rear view of the container showing a package engaging device therein for operative engagement to the package to provide an anti-tampering system.

Referring to FIGS. 8-10, the container and package are interlocked together in a tamper-resistant manner by having a tab from the package operatively enter and remain in a slot provided in the container. As shown in FIGS. 8-10, the rear panel 48 of the package has a three sided die cut 52 with a fourth side 54 remaining uncut. Positioned about the die cut 52 is a tab 56 which is dimensioned slightly larger than a die cut slot provided in the container as described hereinafter.

As shown in FIG. 10, the base 10 of the container 2 includes a corresponding die cut 58 which when pressure is exerted thereon will disengage form the base 10 on three sides forming a slot 60 for receiving the tab 56.

In operation, when it is desired to interlock the package and the container, the tab 56 is moved downwardly against the die cut 52 and through a slot thereby formed in the package. The tab 56 is moved against the die cut 58 in the container to create a slot 60 as the resulting tab 64 of the base 10 is moved away. The tab 56 thereby enters the slot 60 and because the tab 56 is larger than the slot 60 when it enters therein it reverts to its previous position so that it is secured within the slot 60 to thereby lockingly engage the package to the container.

In removing the sleeve type package 44 from its position circumscribing the container 2, the package, which is typically made of a soft pliable paper board, will rip as the container is disengaged from the package 44. Therefore, if an attempt is made to tamper with the contents of the container while the package is thereon, damage will occur to the package which can be readily observed by a consumer.

It will be understood that other configurations of the tab/slot system of engaging the sleeve type package and the container may be made such as by changing the shape of the flap and the slot, in size and the like. It will be further understood that other anti-tampering systems may be employed including, but not limited to, the use of shrink wrap packaging and the like.

What is claimed is:

1. A container for storing cleaning pads comprising:

a) a housing containing a storage compartment for storing unused cleaning pads;

b) unused cleaning pads stored within the housing comprising a plurality of scorelines which when pressure is applied by the user to the cleaning pad a handle is formed;

c) a lid having an upper surface operatively engaged to the housing for reversibly covering the storage compartment and movable from an open position enabling unused cleaning pads to be removed from the storage compartment to a closed position with the upper surface positioned above the storage compartment; and d) a used cleaning pad storage area on the upper surface of the lid comprising a base and a plurality of sides with at least one pair of opposed parallel sides and a first liquid collection area bounded by the base and the sides, at least one pair of spaced apart rails extending upwardly from the base and having a pair of opposed ends operatively engaged to respective opposed parallel sides of the used cleaning pad storage area, said rails having a curved outer surface and extending only partially up the opposed parallel sides to define an upper opposed side portion which together with the curved outer surface of the rails provide a used cleaning pad support region for fixedly supporting the used cleaning pad with minimal contact with the rails and out of contact with the base along at least a substantial length of the opposed parallel sides thereof, to enable excess liquid contained in the used cleaning pad to enter the first liquid collection area out of contact with the used cleaning pad.

2. The container of claim 1 wherein the unused cleaning pad comprises at least one group of three scorelines.

3. The container of claim 1 wherein the housing further comprises a packaging engaging attachment device for securing the container to a package wherein when the container is removed from the packaging said container can no longer be secured to the packaging.

4. The container of claim 3 wherein the packaging engaging attachment device comprises a flap in one of said container or package insertable into a slot in the other of said container or package wherein removal of the package from the container results in the flap being damaged.

5. The container of claim 1 further comprising:

a package placed over at least a portion of the container to form a packaged container and providing point of sale information about the container.

6. The container of claim 5 further comprising anti-tampering means to prevent or deter tampering with the packaged container.

7. The container of claim 5 wherein the container further comprises a package engaging attachment device for engaging a container engaging attachment device associated with the package wherein when the packaged container is positioned for point of sale purchase display, said packaging engaging attachment device and container engaging attachment are connected and when the package is removed from the container and thus no longer covers the container, the respective devices are irrevocably disengaged from each other.

8. The container of claim 1 wherein the cleaning pad comprises at least one first group of scorelines existing along a first axis of the cleaning pad and at least one second group of scorelines extending along a second axis of the cleaning pad to enable a handle to be formed in the direction of either the first or second axis.

9. The container of claim 8 wherein the first axis is perpendicular to the second axis.

10. The container of claim 8 wherein the plurality of scorelines comprises two scorelines for forming a base of the handle and a third scoreline positioned between the two other scorelines for forming an apex of the handle.

11. The container of claim 1 wherein at least one pair of spaced apart rails extends from a side of the used cleaning pad storage area to another side.

12. The container of claim 11 wherein the used cleaning pad storage area comprises two pair of opposed sides.

13. The container of claim 12 comprising a pair of spaced apart rails extending between one pair of said opposed sides.

14. The container of claim 13 comprising a second pair of spaced rails extending from said pair of opposed sides.

15. The container of claim 13 wherein the spaced apart rails together with the base and sides define at least one additional liquid collection area.

16. The container of claim 15 wherein the spaced apart rails together with the base and sides define two additional liquid collection areas.

17. The container of claim 1 wherein the lid is hingedly secured to the housing.

18. The container of claim 1 wherein the depth of the first liquid collection area is sufficient to insure that excess liquid contained therein and received from the used cleaning pad does not contact the used cleaning pad when the used cleaning pad is stored in the fixedly supported position.

* * * * *